US011217881B1

(12) United States Patent
Cencich et al.

(10) Patent No.: US 11,217,881 B1
(45) Date of Patent: Jan. 4, 2022

(54) SPIRAL ANTENNA WITH COILED WALLS

(71) Applicant: Lockheed Martin Corporation, Bethesda, MD (US)

(72) Inventors: Thomas Patrick Cencich, Littleton, CO (US); W. Neill Kefauver, Littleton, CO (US); Timothy Edward Palagi, Littleton, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 16/675,116

(22) Filed: Nov. 5, 2019

(51) Int. Cl.
*H01Q 1/36* (2006.01)
*H01Q 7/00* (2006.01)

(52) U.S. Cl.
CPC ..... *H01Q 1/36* (2013.01); *H01Q 7/00* (2013.01)

(58) Field of Classification Search
CPC ..... H01Q 1/36; H01Q 9/27; H01Q 19/10; H01Q 1/007; H01Q 1/27; H01Q 1/28; H01Q 1/38; H01Q 21/00; H01Q 25/02; H01Q 7/00
USPC ..... 343/866, 789
See application file for complete search history.

(56) References Cited

U.S. PATENT DOCUMENTS

| | | | | |
|---|---|---|---|---|
| 4,012,744 | A * | 3/1977 | Greiser | H01Q 9/27 343/895 |
| 6,291,793 | B1 * | 9/2001 | Qian | H01J 37/32082 118/723 I |
| 7,692,603 | B1 * | 4/2010 | Cencich, Sr. | H01Q 1/36 343/895 |
| 7,871,490 | B2 * | 1/2011 | Kim | H01J 37/321 156/345.48 |
| 9,362,614 | B1 * | 6/2016 | Neel | H01Q 1/50 |
| 9,748,940 | B2 * | 8/2017 | Jain | H03K 7/08 |
| 10,505,584 | B1 * | 12/2019 | Henry | H04B 3/52 |
| 10,546,686 | B2 * | 1/2020 | Verschueren | H01Q 7/08 |
| 10,686,250 | B1 * | 6/2020 | Oster | H01Q 1/246 |
| 10,903,688 | B2 * | 1/2021 | Peralta | H01F 27/2885 |
| 2001/0000604 | A1 * | 5/2001 | Qian | H05H 1/46 219/121.43 |

* cited by examiner

*Primary Examiner* — Linh V Nguyen
(74) *Attorney, Agent, or Firm* — Morgan, Lewis & Bockius LLP

(57) ABSTRACT

A spiral antenna device includes one or more conductive spiral arms that are formed on a dielectric substrate attached to a wall of a cylindrical cavity. One or more coils are formed on the wall of the cylindrical cavity and are coupled to the one or more conductive spiral arms. Starting points of the one or more conductive spiral arms are in a center region of the dielectric substrate and ending points of the one or more conductive spiral arms are electrically coupled to first ends of the one or more coils.

20 Claims, 12 Drawing Sheets

SPIRAL ANTENNA WITH COILED WALLS

STATEMENT REGARDING FEDERALLY SPONSORED RESEARCH OR DEVELOPMENT

Not Applicable.

FIELD OF THE INVENTION

The present invention generally relates to antenna technology and, more particularly, to a spiral antenna with coiled walls.

BACKGROUND

Antennas operate to control energy wave propagation and are critical components for various wireless transmission and reception systems, such as telecommunication, aerospace, and/or data transmission systems in general. Edwin Turner is credited with first generally investigating the spiral antenna in 1954 when he wound a long wire dipole into a spiral form and connected its terminals to a two-wire feed line. Results from his experiments have spurred further investigation that continues even today. Spiral antennas have been designed in various planar or conical shapes, the most common being the equiangular and Archimedean.

Spiral antennas can simultaneously operate in three fashions: as fast-wave, leaky-wave, and traveling-wave antennas. Excited currents in the spiral antenna conductors form a traveling wave that allows for broadband performance. The traveling wave of a fast-wave antenna has a phase velocity in excess of the speed of light because of the mutual coupling between neighboring arms of the antenna. The traveling wave of the spiral antenna radiates continuously along its length, and hence the corresponding propagation wave number $k_z$ is complex and consists of both a phase and an attenuation constant, resulting in leaking energy while propagating.

SUMMARY

According to various aspects of the subject technology, methods and configuration for providing a wideband circularly polarized spiral antenna with an electrically small footprint are disclosed. The spiral antenna of the subject technology features cavity walls with embedded coils.

In one or more aspects, a spiral antenna device includes one or more conductive spiral arms that are formed on a dielectric substrate attached to a wall of a cylindrical cavity. The Coils are formed on the wall of the cylindrical cavity and are coupled to the one or more conductive spiral arms. Starting points of the conductive spiral arms are in a center region of the dielectric substrate and ending points of the conductive spiral arms are electrically coupled to wall coils.

In other aspects, a spiral antenna device includes a cavity having a cylindrical wall and a dielectric substrate covering a first opening of the cavity. One or more conductive spiral arms are formed on the dielectric substrate and have their respective starting points in a center region of the dielectric substrate. One or more coils are implemented on the cylindrical wall. Ending points of the one or more conductive spiral arms are positioned on one or more different points of a periphery of the dielectric substrate and are electrically coupled to first ends of the one or more coils.

In yet other aspects, a spiral antenna device with coiled walls includes a cavity having a cylindrical wall, and one or more coils implemented on the cylindrical wall. The one or more coils include one of interlaced coils or noninterlaced coils. The one or more coils are formed on both sides of the wall of the cavity. The interlaced coils wrap around the cylindrical wall together, and the noninterlaced coils are formed on separate peripheral segments of the cylindrical wall.

The foregoing has outlined rather broadly the features of the present disclosure so that the following detailed description can be better understood. Additional features and advantages of the disclosure, which form the subject of the claims, will be described hereinafter.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein.

DETAILED DESCRIPTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block diagram form in order to avoid obscuring the concepts of the subject technology.

In some aspects of the present technology, methods and configuration are disclosed for providing a wideband circularly polarized spiral antenna with a small footprint. The cavity walls of the spiral antenna of the subject technology include embedded coils. The spiral antenna of the subject technology may operate from approximately 200 MHz to upwards of several GHz within a payload space of only about five inches in diameter and less than one inch in height; the technology retains the frequency independent nature of a conventional spiral, but with improved performance at frequencies below 1 wavelength circumference The disclosed spiral antenna features gain improvement over a number of existing solutions, while having a simpler structure with smaller dimensions. For example, the gain of the spiral antenna of the subject technology at low frequencies (e.g., about 200 MHz) is more than eight dB higher compared to the previously disclosed coiled spiral antenna that does not implement coils on the antenna walls. The implementation of the coils in the cavity walls of the antenna allows for a significantly better use of the available volume, a feature that is very important for electrically small antennas. At higher frequencies where the antenna is not electrically small, above 1 lambda circumference, the disclosed antenna has a normal spiral antenna design and does not suffer from degradations experienced by other design concepts.

Further, the disclosed spiral antenna maximizes circularly polarized gain over an octave, while maintaining a low cross-polarization and minimizing size, weight and volume. The broad frequency response in conjunction with a higher gain and a small space profile improves space limitations and payload for deployable and nondeployable platforms while reducing opportunities for electromagnetic interference.

Figure 1A:
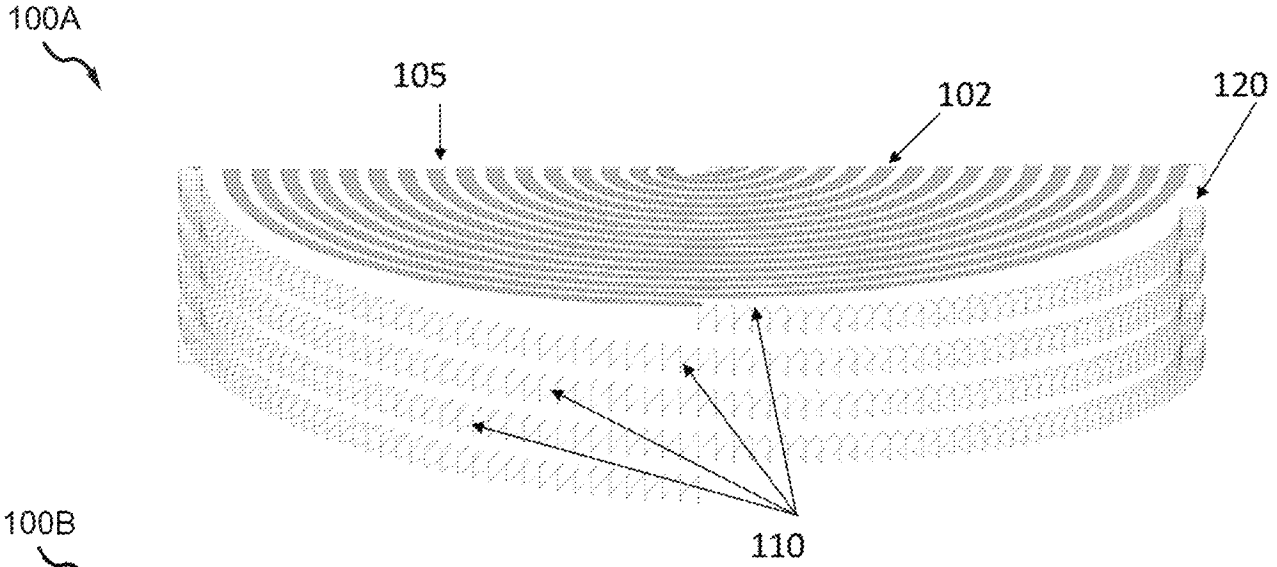
FIG. 1A is a diagram illustrating an example of a spiral antenna structure with interlaced coiled walls, according to certain aspects of the disclosure.
Figure 1B:
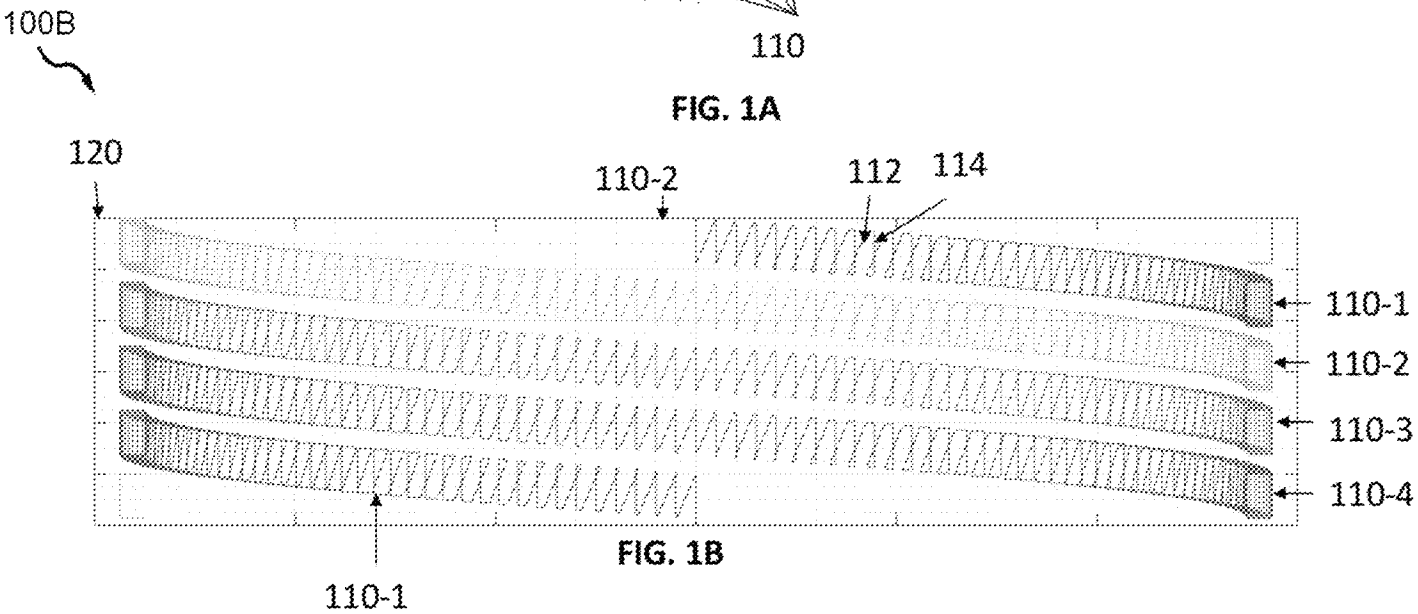
FIG. 1B is a diagram illustrating a side view of the front half of wall coils of the example spiral antenna structure of FIG. 1A, according to certain aspects of the disclosure.

FIG. 1 is diagram illustrating an example of a spiral antenna structure 100A with interlaced coiled walls. according to certain aspects of the disclosure. The spiral antenna structure 100A includes a wall 120 and a top surface 102. The top surface 102 includes a number of (e.g., one or more) planar conductive spiral arms 105. The wall 120 can be made of one or more dielectric materials with different dielectric constants. The wall 120 includes a number of (e.g., one or more) coils 110 embedded in the wall 120, as explained herein. The wall 120 embraces a cylindrical cavity. The coils 110 can be arranged in an interlaced configuration, as shown in FIG. 1B below. The coils 110 can be made of conductive wires (e.g., copper, silver, aluminum or gold) or can be printed as conductive traces on the sides of the wall 120. Other configurations of the coils are possible as will be discussed herein. The coils 110 include multiple conductive loops, each formed of inner and outer conductive elements alternately formed on an inner and outer surface of the wall of the cylindrical cavity. The coils 110 can have different coil periods, amplitudes and trace thicknesses, as explained in more detail herein.

FIG. 1B is a diagram illustrating a side view of the front half of wall coils 110 of the example spiral antenna structure 100A of FIG. 1A, according to certain aspects of the disclosure. The side view shown in FIG. 1B depicts four coils 110-1, 110-2, 110-3 and 110-4. The coils 110-1, 110-2, 110-3 and 110-4 are formed on the wall 120 in an interlaced configuration. Each coil (e.g., 110-1) is formed by conductive loops, and each loop is formed by an inner element 112 coupled to an outer element 114 by using vias passing through the thickness of the wall 120. In one or more implementations, the starting points of the coils 110-1, 110-2, 110-3 and 110-4 can be at different positions on the wall 120, and the coils 110-1, 110-2, 110-3 and 110-4 may feature different coil periods, amplitudes and trace thicknesses.

Figure 2:
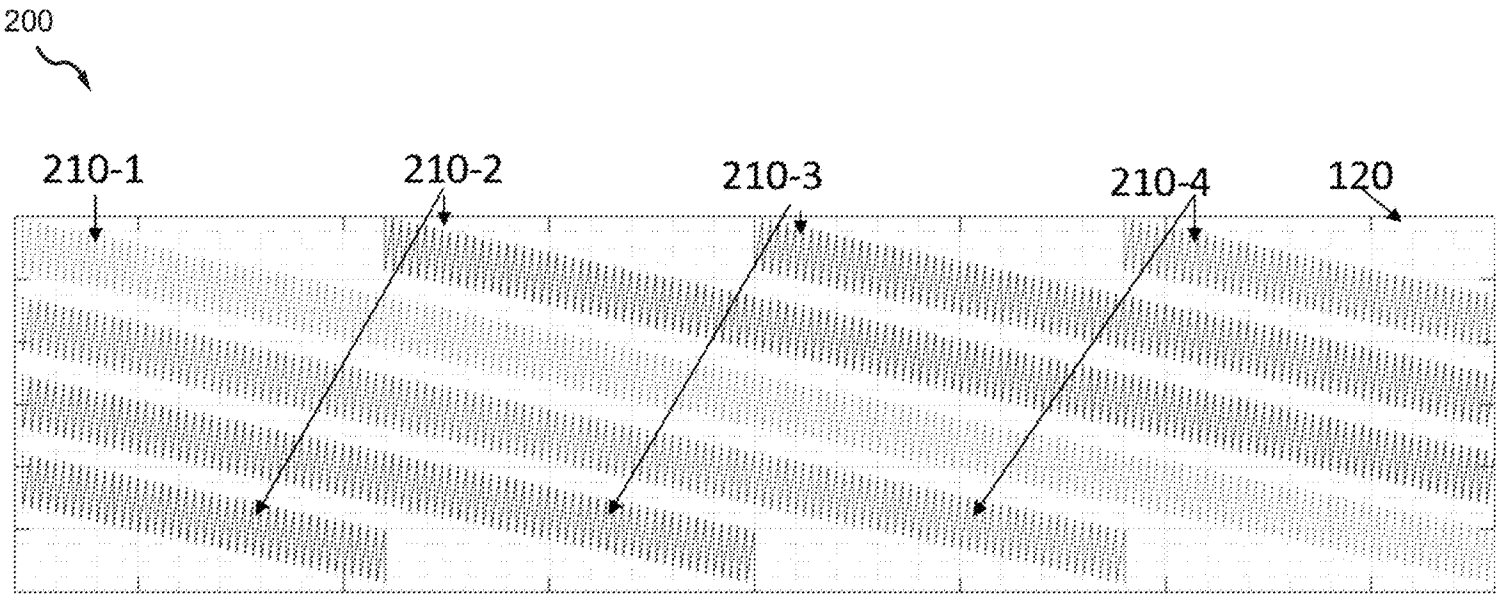
FIG. 2 is a diagram illustrating a cylindrical unwrapped view of the example spiral antenna structure of FIG. 1, according to certain aspects of the disclosure.

FIG. 2 is a diagram illustrating an unrolled cylindrical view 200 of the example spiral antenna structure 100 of FIG. 1, according to certain aspects of the disclosure. The unrolled cylindrical view 200 shows the wall 120 of the spiral antenna structure 100. The coils 210 (210-1, 210-2, 210-3 and 210-4) are formed on the wall 120 in an interlaced configuration. The coils 210 can be made of conductive wires (e.g., copper, silver, aluminum or gold) or can be printed as conductive traces on the sides of the wall 120. In one or more implementations, the starting points of the coils 210 can be at different positions on the wall 120, as shown in FIG. 2, and the coils 210 may feature different coil periods, amplitudes and trace thicknesses.

Figure 3:
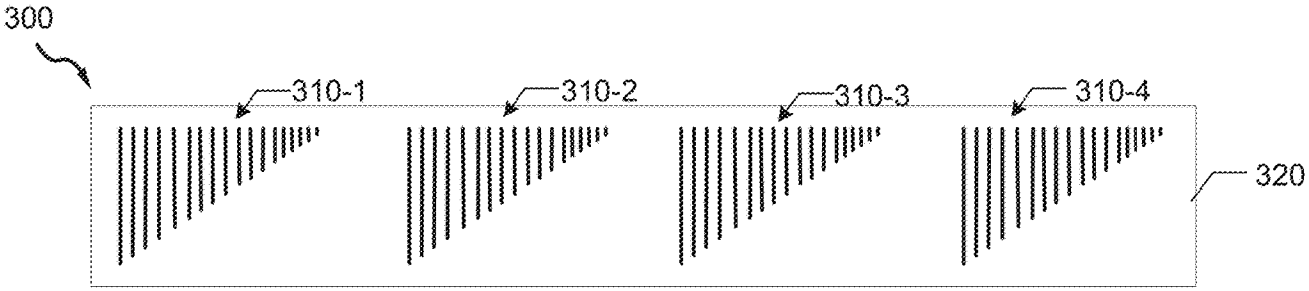
FIG. 3 is a diagram illustrating an unrolled cylindrical view of an example of a spiral antenna structure with noninterlaced coiled walls, according to certain aspects of the disclosure.

FIG. 3 is a diagram illustrating an unrolled cylindrical view 300 of an example of a spiral antenna structure with noninterlaced coiled walls, according to certain aspects of the disclosure. The unrolled cylindrical view 300 shows a wall 320 of a spiral antenna structure, including a group of noninterlaced coils 310 (310-1, 310-2, 310-3 and 310-4) that are formed on the wall 320. The coils 310 are formed of multiple loops including inner and outer elements. FIG. 3 only shows the outer elements that are formed on an outer surface of the wall 320. The coils 310 are similar in configuration, for example, have similar loop periods and amplitudes. In some implementations, the coils can have different configurations as shown and discussed below.

Figure 4:
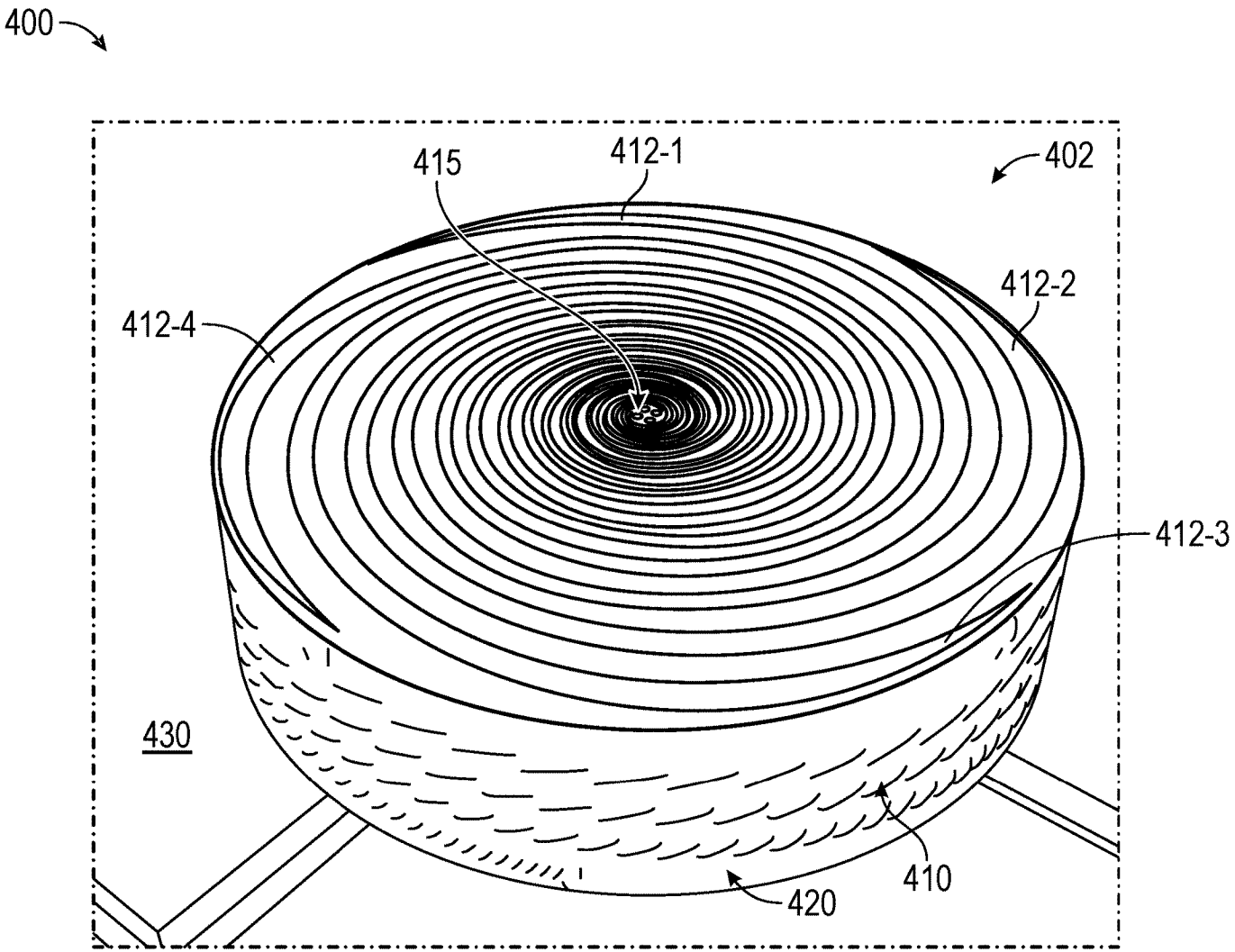
FIG. 4 is a diagram illustrating an example of a spiral antenna structure with interlaced coiled walls, according to certain aspects of the disclosure.

FIG. 4 is a diagram illustrating an example of a spiral antenna structure 400 with interlaced coiled walls. according to certain aspects of the disclosure. The spiral antenna structure 400 includes a top planar surface 402 that works as a substrate for a number of spiral arms 412 (412-1, 412-2, 412-3 and 412-4) and a wall 420. The top planar surface 402 can be made of a dielectric material. The spiral arms 412 are made of a conductive material (e.g., copper, silver, aluminum or gold), and have their starting points in a center region 415 of the top planar surface 402. The ending points of the conductive spiral arms 412 are positioned at different points of a periphery of the top planar surface 402, where the first ends of the coils 410 are positioned and are connected to the ending points of the conductive spiral arms 412. The configuration of the coils 410 is the interlaced configuration shown in FIG. 2. The spiral antenna structure 400 is mounted on ferrite absorber backplane 430 with dimensions of about four inches. Also shown in FIG. 4 is an aluminum ground plane 432, which is under the ferrite absorber backplane 430. The ferrite absorber 430 may also be cut into a circular shape and located inside the dielectric cavity 450. In some implementations, the tiles can also be made circular and located inside of the cavity with a metallic bottom layer.

Figure 5:
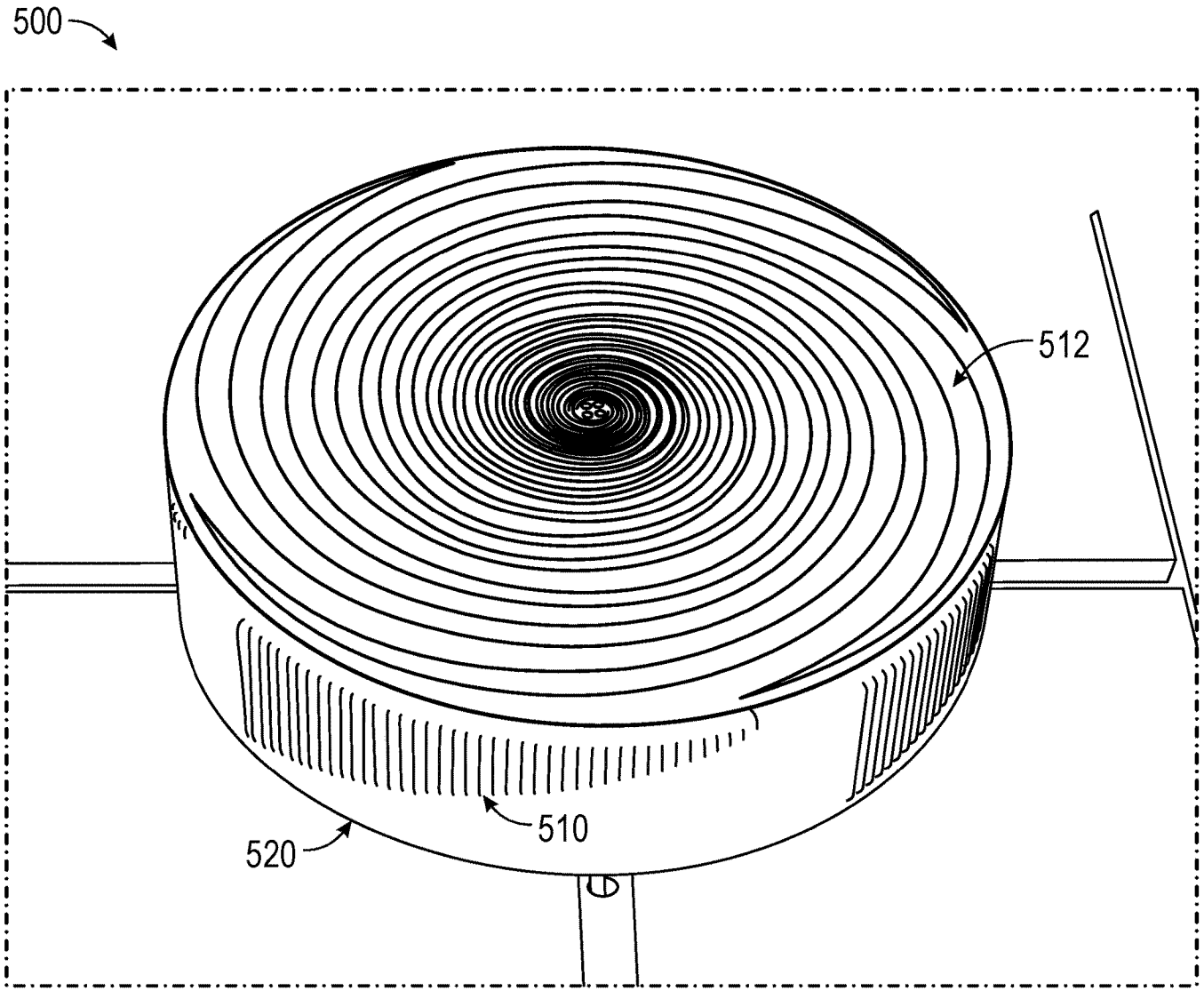
FIG. 5 is a diagram illustrating an example of a spiral antenna structure with noninterlaced coiled walls, according to certain aspects of the disclosure.

FIG. 5 is a diagram illustrating an example of a spiral antenna structure 500 with a noninterlaced coiled walls. according to certain aspects of the disclosure. The spiral antenna structure 500 includes a top planar surface including a number of spiral arms 512 (similar to the spiral arms 412 of FIG. 4) and a wall 520. The ending points of the conductive spiral arms 512 are positioned at different points of a periphery of the top planar surface and are connected to the first ends of the coils 510. The configuration of the coils 510 is similar to the configuration of the coils 310 of FIG. 3.

Figure 6:
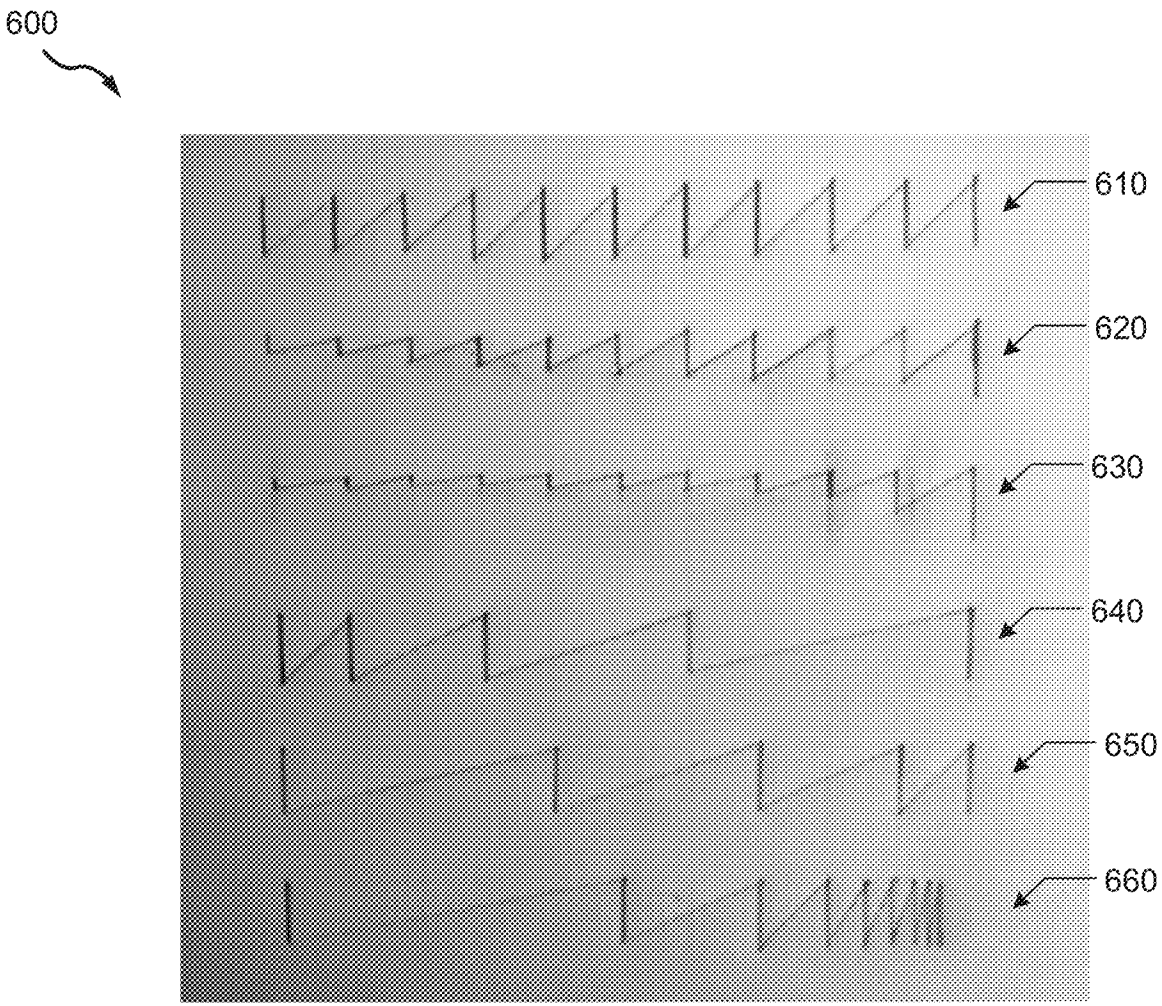
FIG. 6 is a diagram illustrating example variations of coil structures of a spiral antenna structure with coiled walls, according to certain aspects of the disclosure.

FIG. 6 is a diagram illustrating example variations of coil structures 610, 620, 630, 640, 650 and 660 of a spiral antenna structure with coiled walls. according to certain aspects of the disclosure. The coil structure of a spiral antenna structure can be implemented in a variety of configurations. For example, the coil structures 610, 620, 630, 640, 650 and 660, as shown in FIG. 6, have different configurations such as amplitudes and periods. For instance, the coils structure 610 is a constant amplitude and period configuration. The coils structure 620 has a linearly increasing coil amplitude across various loops with a constant period. The coils structure 630 shows exponentially increasing coil amplitude across various loops with a constant period. In the coils structure 640, the coil amplitude is constant across various loops with the coil period linearly increasing. For the coils structure 650 the coil amplitude is constant across various loops, but the coil period is linearly decreasing. In the case of the coils structure 660, the coil amplitude is kept constant across various loops, but the coil period is decreased exponentially.

Figure 7:
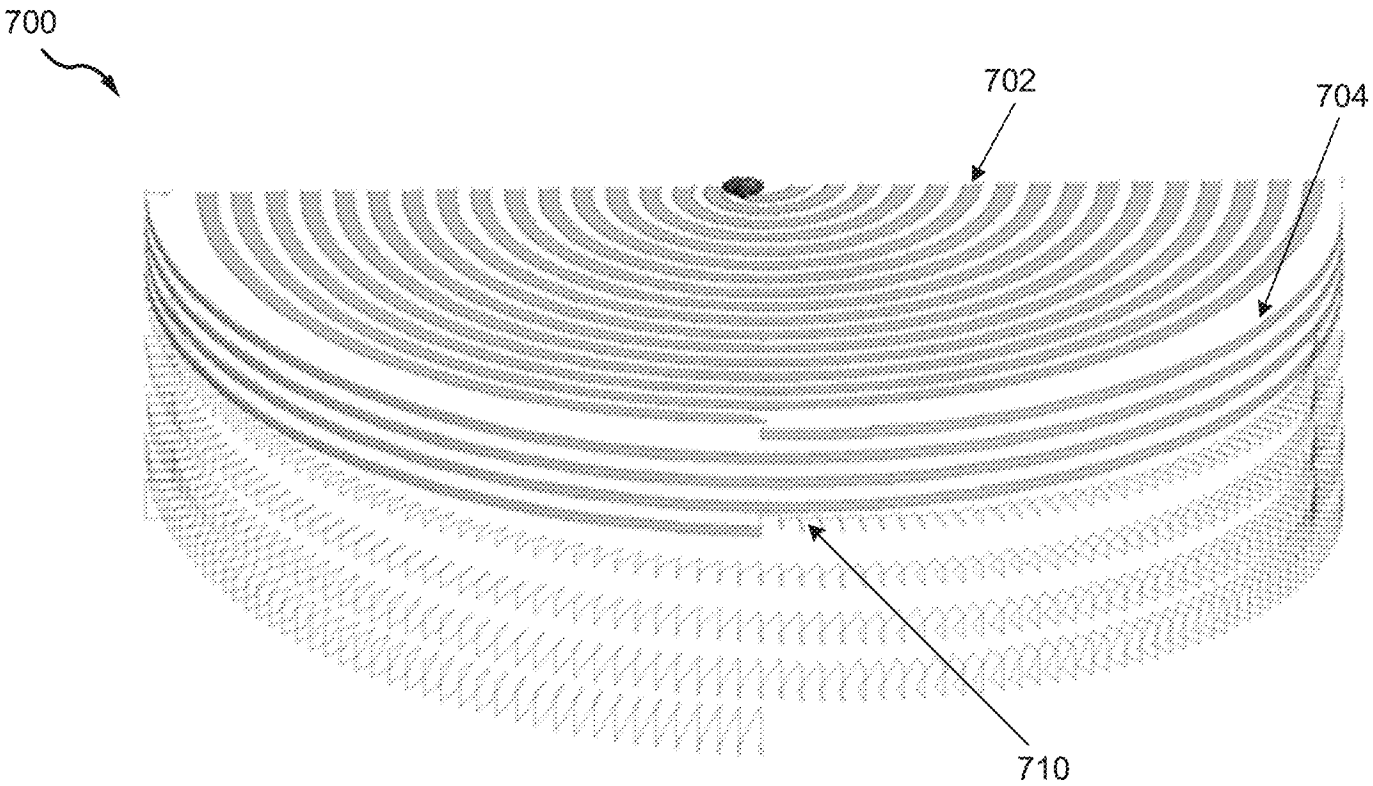
FIG. 7 is a diagram illustrating an example coil structure of a spiral antenna with a helix termination, according to certain aspects of the disclosure.

FIG. 7 is a diagram illustrating an example coil structure of a spiral antenna 700 with a helix termination, according to certain aspects of the disclosure. The spiral antenna 700 includes a number of spiral arms 7022, at least one of which can be terminated with a helix termination 704. The helix termination 704 is coupled to a coil 710, which is similar to the coils 110 of FIG. 1A.

Figure 8:
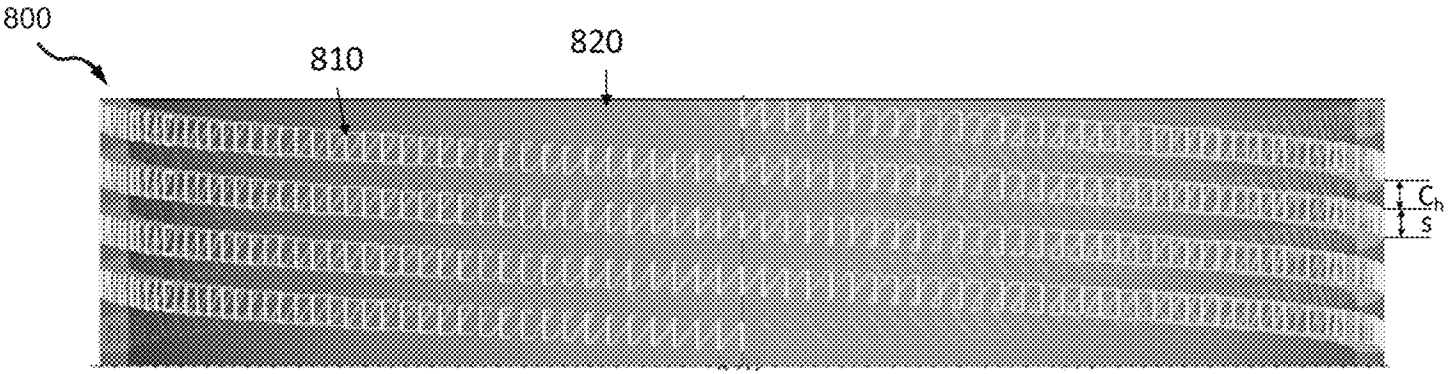
FIG. 8 is a diagram illustrating an example coil structure of a spiral antenna with interlaced coiled walls with equal coil height ($C_h$) and spacing (s) to the next arm, according to certain aspects of the disclosure.

FIG. 8 is a diagram illustrating a side view of an example coil structure 800 of a spiral antenna with interlaced coiled walls with equal coil height ($C_h$) and spacing (s) to the next arm, according to certain aspects of the disclosure. The coil structure 800 includes a single coil 810 formed on a wall 820 and includes about 180 loops with a constant loop height of about 0.125 inches and a constant loop period of about 2 degrees. The loops can be made out of conductive (e.g., metallic) wires or strips as discussed above. The side view also depicts the coil height, $C_h$, and the spacing, S, between the coils.

Figure 9:
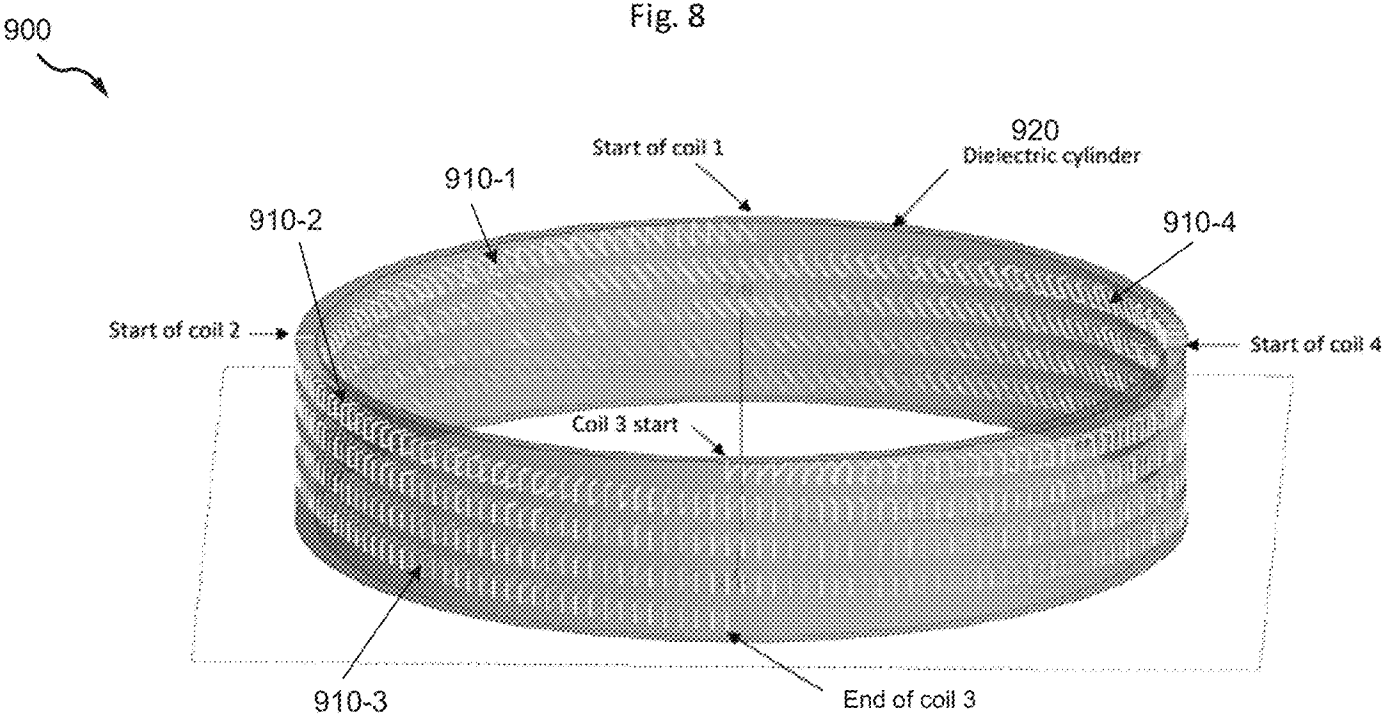
FIG. 9 is a diagram illustrating a perspective view of an example coil structure of a spiral antenna with interlaced coiled walls. according to certain aspects of the disclosure.

FIG. 9 is a diagram illustrating a perspective view of an example coil structure 900 of a spiral antenna with interlaced coiled walls. according to certain aspects of the disclosure. The perspective view reveals inner and outer surfaces of a dielectric cylindrical wall 920 of the example coil structure 900, which has four interlaced coils: coil 1 (910-1), coil 2 (910-2), coil 3 (910-3) and coil 4 (910-4). The perspective view also shows the starting points of the four interlaced coils to be distributed around a periphery of a top surface of the wall. The starting points of the four coils being on the periphery of the top surface of the wall allows connection of the four coils to four conductive spiral arms, which are not shown here but are implemented on a substrate that is placed on the top surface of the wall, as shown in FIGS. 3, 4 and 5.

Figure 10:
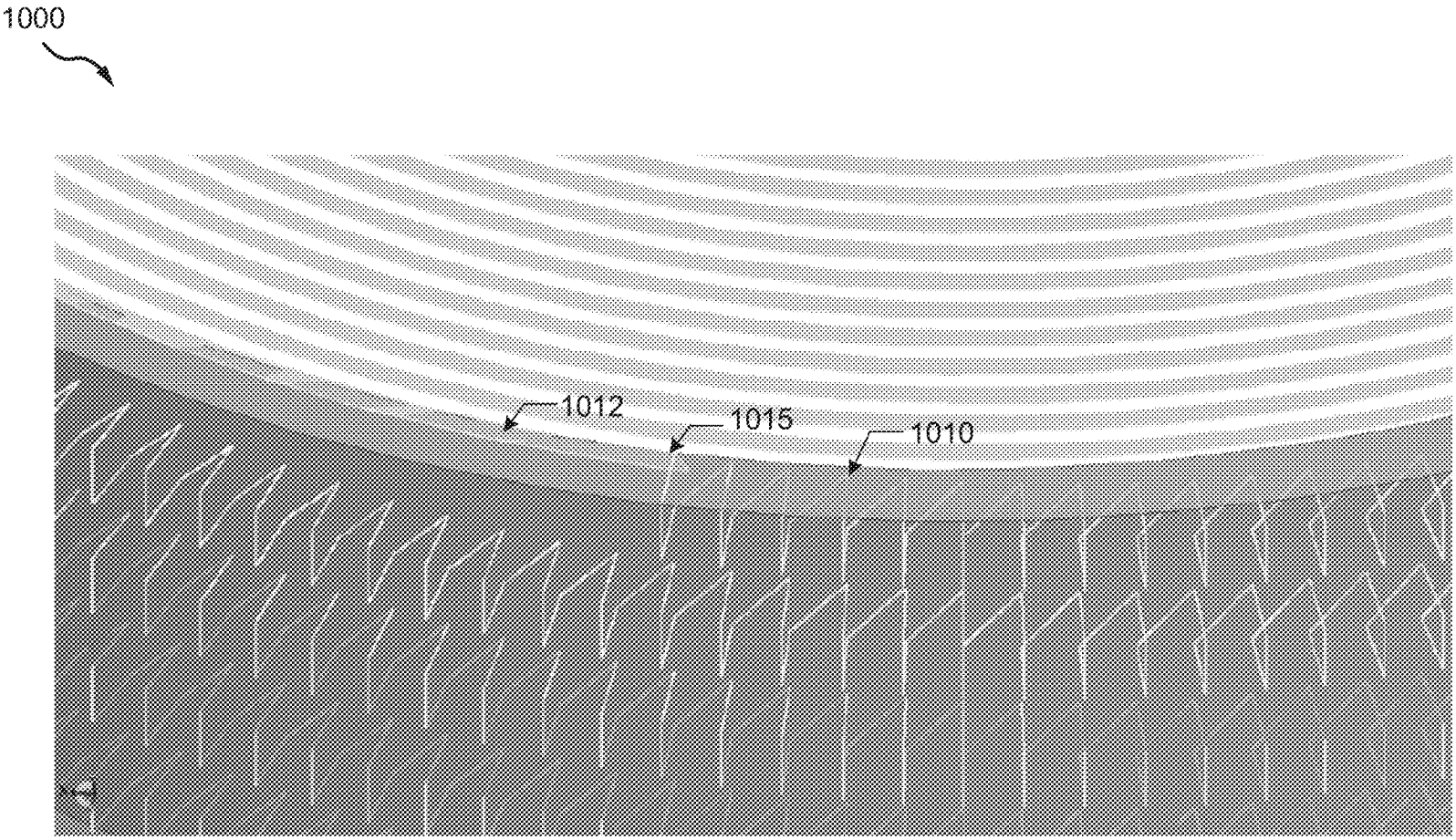
FIG. 10 is a diagram illustrating an example interface of a spiral arm and a coil of a spiral antenna with interlaced coiled walls. according to certain aspects of the disclosure.

FIG. 10 is a diagram illustrating an example interface of a spiral arm and a coil of a spiral antenna with interlaced coiled walls. according to certain aspects of the disclosure. The close-up view shown in FIG. 150 reveals a connection at point 1015 between a conductive spiral arm 1012 and a starting point of a loop of a coil 1010. The connection of arms of the conductive spiral to the starting points of the coils of the spiral antenna with interlaced coiled wall is not limited to the scheme shown in FIG. 10 and can be implemented in other ways.

Figure 11:
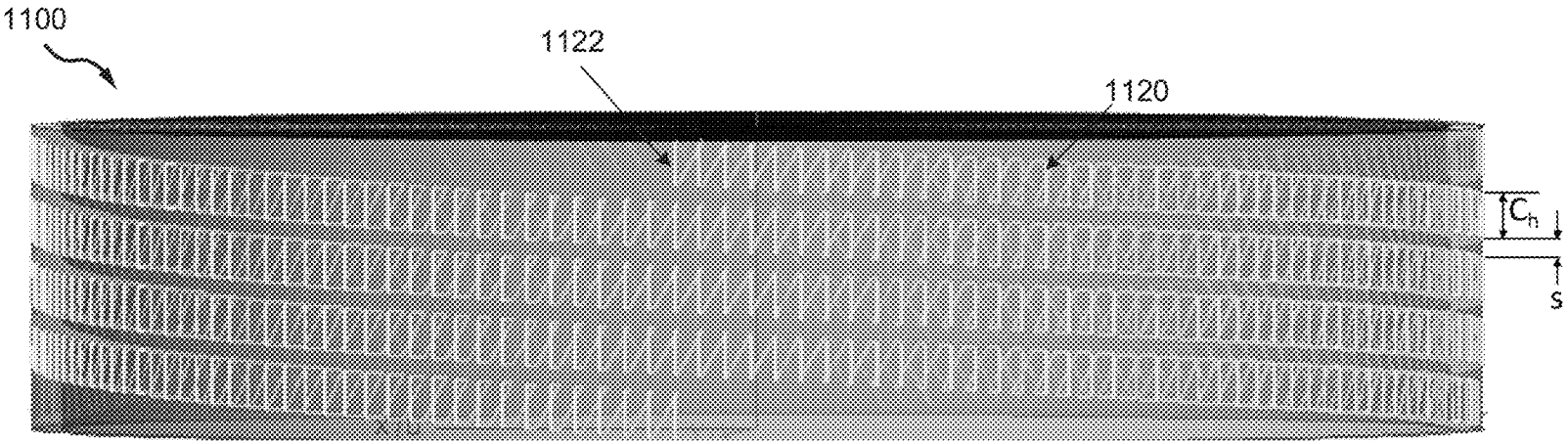
FIG. 11 is a diagram illustrating an example coil structure of a spiral antenna with single-coiled walls with not equal coil height ($C_h$) and spacing (s), according to certain aspects of the disclosure.

FIG. 11 is a diagram illustrating an example coil structure of a spiral antenna 1100 with single-coiled walls. according to certain aspects of the disclosure. The spiral antenna 1100, as shown in FIG. 11, has a single coil 1120 with a starting point 1122 that connects an end point of a conductive spiral arm, for example, as shown in FIG. 10. FIG. 11 also depicts the coil height, $C_h$, and the spacing, S, between the coils.

Figure 12:
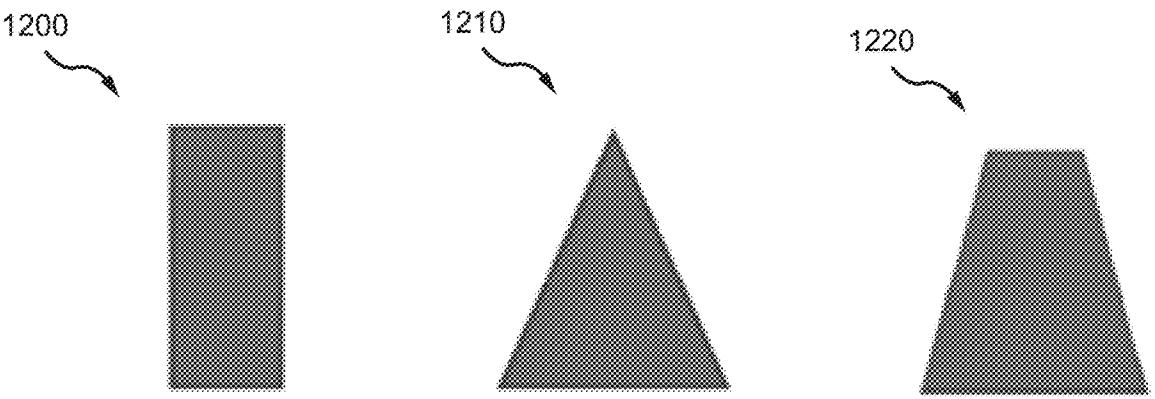
FIG. 12 is a diagram illustrating examples of cross-sectional views of tapering profiles of the wall thickness of a spiral antenna with coiled walls. according to certain aspects of the disclosure.

FIG. 12 is a diagram illustrating examples of cross-sectional views 1200, 1210 and 1220 of tapering profiles of the wall thickness of a spiral antenna with coiled walls. according to certain aspects of the disclosure. The cross-section view 1200 represents a cylindrical wall with no wall tapering. The cross-section view 1210 represents a cylindrical wall with a triangular tapering profile, where the thickness of the wall changes linearly across the height of the wall with a large slope. The cross-section view 1200 represents a cylindrical wall with a trapezoidal tapering profile, where the thickness of the wall changes linearly across the height of the wall with a smaller slope.

Figure 13:
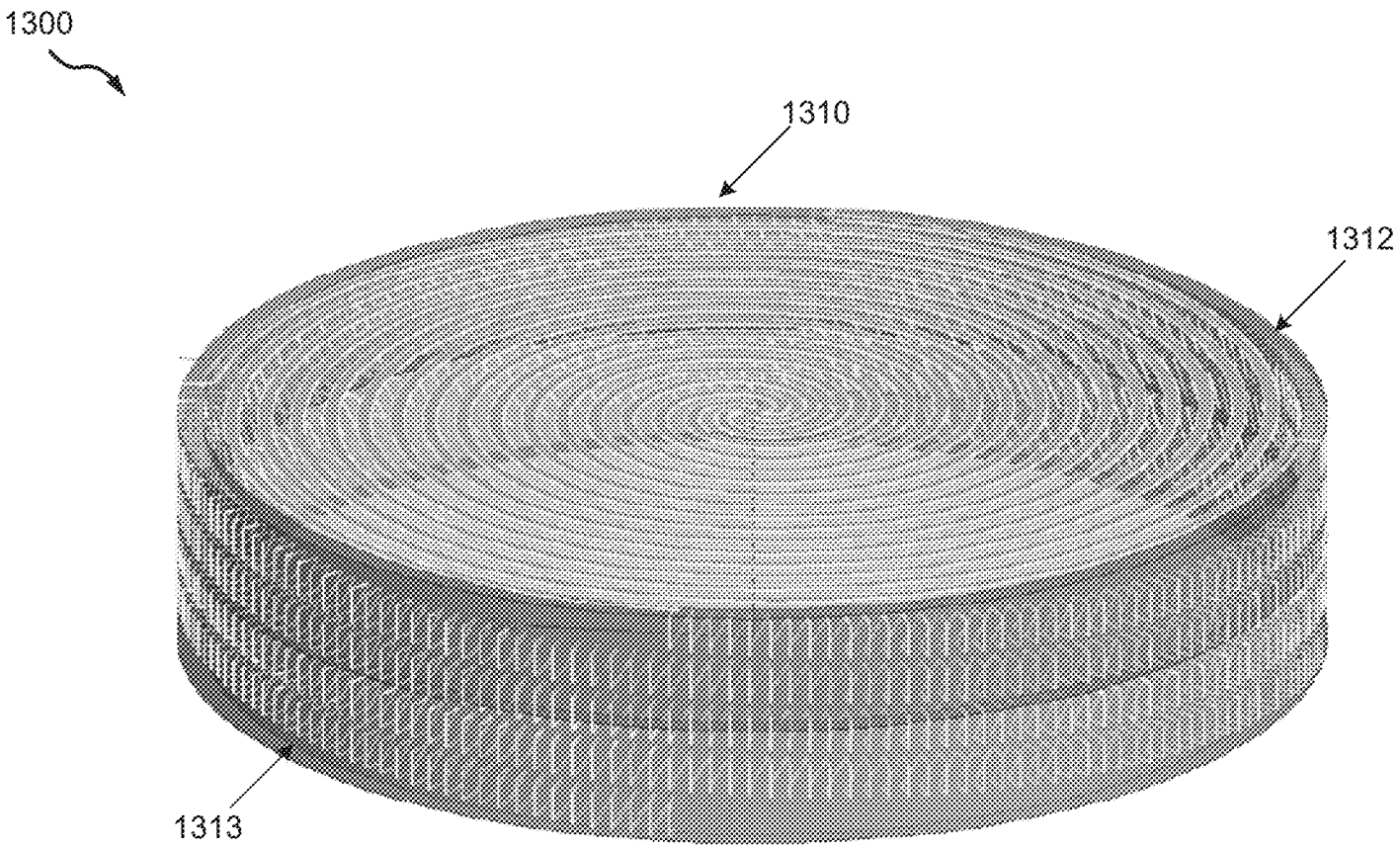
FIG. 13 is a diagram illustrating an example of a spiral antenna structure with coiled wall made of dielectric materials of different dielectric constant, according to certain aspects of the disclosure.

FIG. 13 is a diagram illustrating an example of a spiral antenna structure 1300 with coiled wall made of dielectric materials of different dielectric constants, according to certain aspects of the disclosure. The dielectric wall of the spiral antenna structure does not need to be made of a single dielectric material with a single dielectric constant. The dielectric constant of the dielectric wall material can vary, for example, across the height of the wall. In the spiral antenna structure 1300, for instance, the wall 1310 of the spiral antenna includes an upper section 1312 and a lower section 1314 that are made of dielectric materials with different dielectric constants.

Figure 14:
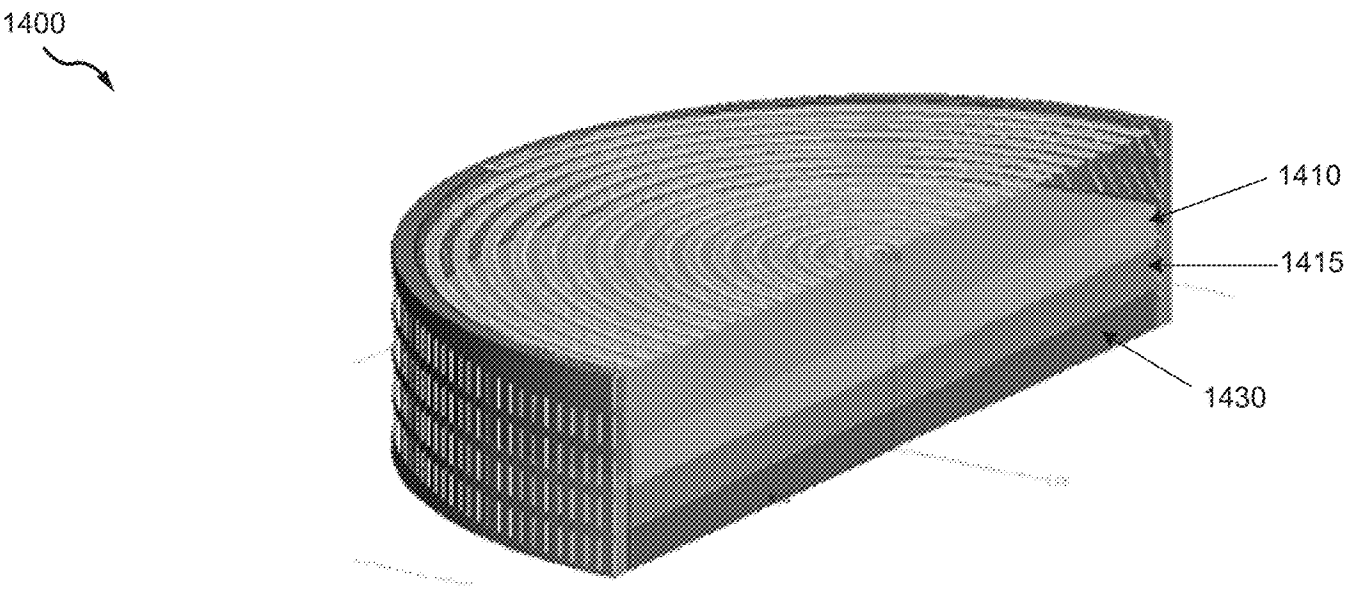
FIG. 14 is a diagram illustrating an example of a spiral antenna structure with coiled wall and a cavity loaded with different absorbers, according to certain aspects of the disclosure.

FIG. 14 is a diagram illustrating an example of a spiral antenna structure 1400 with coiled wall and a cavity loaded with different absorber layers 1410, 1420 and 1430, according to certain aspects of the disclosure. The cavity formed by the wall and the top surface of a spiral antenna structure can be filled with one or more electromagnetic (EM) absorber layers (e.g., carbon foam). The electromagnetic absorber layers (e.g., 1410, 1420 and 1430) need not be made of the same absorber material and can be made of different absorbents, for example, with different EM absorption properties. The spiral cavity can have a metallic bottom, under the absorber.

Figure 15:
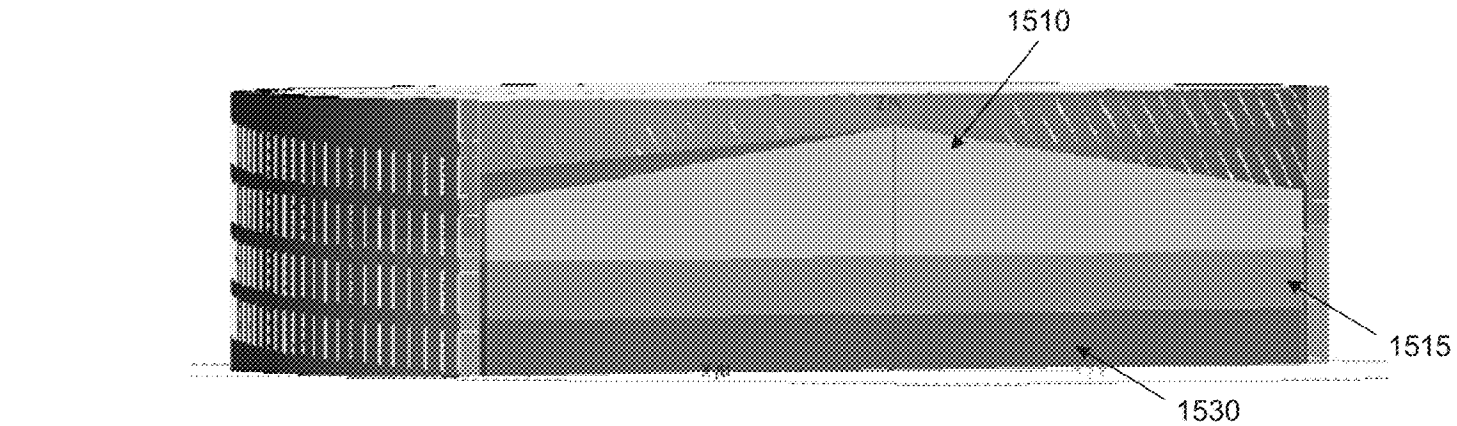
FIG. 15 is a diagram illustrating an example of a spiral antenna structure with coiled wall and a cavity loaded with different absorbers with different configurations, according to certain aspects of the disclosure.

FIG. 15 is a diagram illustrating an example of a spiral antenna structure 1500 with coiled wall and a cavity loaded with different absorbers with different configurations, according to certain aspects of the disclosure. The electromagnetic absorber layers filling the cavity of a spiral antenna structure do not have to have similar profiles, and configurations different from the configuration of FIG. 14 may be implemented. For example, in the spiral antenna structure 1500, the top absorber layer 1510 has a conical profile, whereas the lower absorber layers 1520 and 1530 are flat planar layers. The flexibility of the material and profile of the absorber layers translates into design flexibility of the spiral antenna structure that allows adjustment of antenna parameters (e.g., gain and bandwidth).

Figure 16:
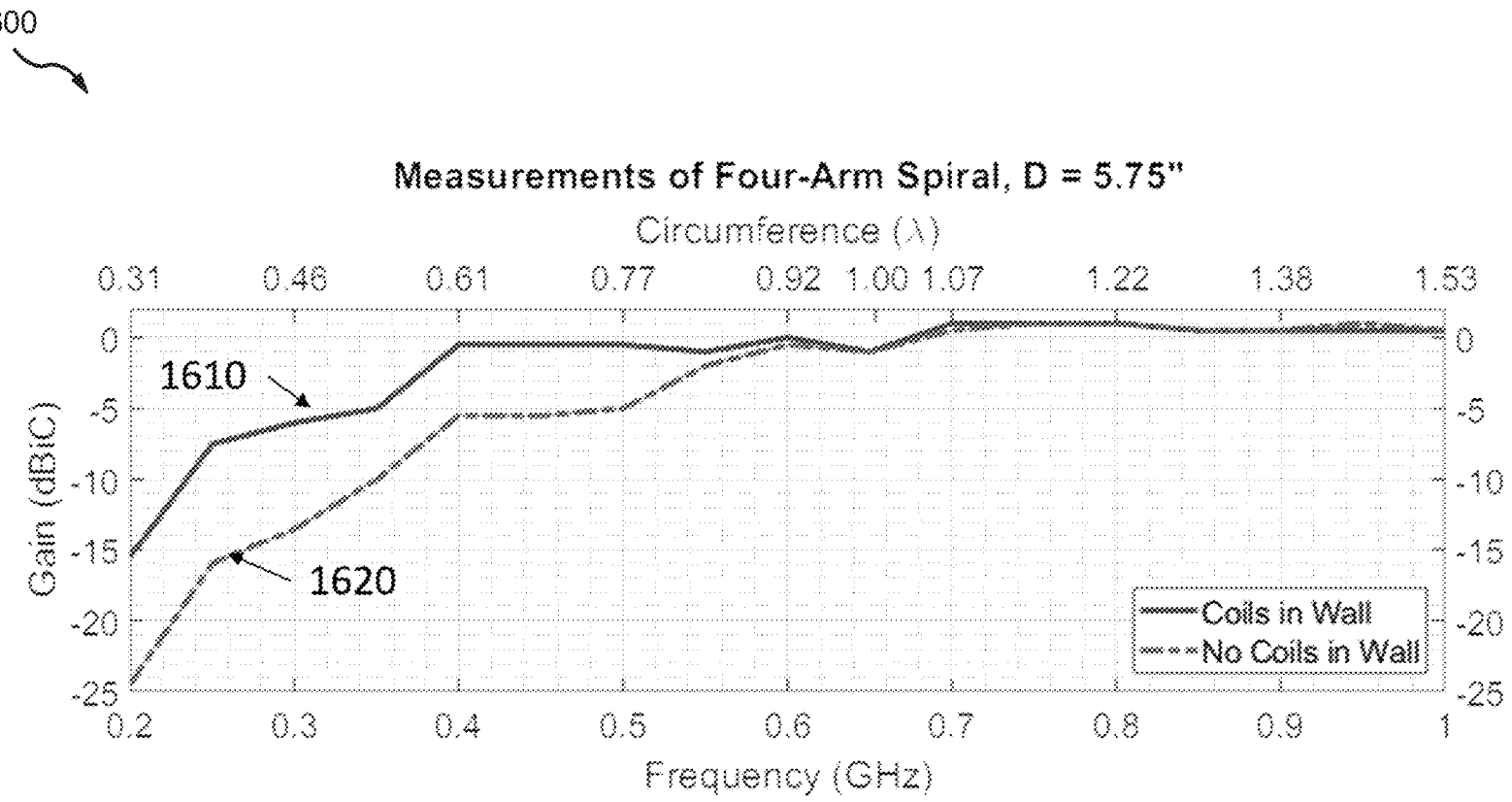
FIG. 16 is a chart illustrating gain-versus-frequency plots depicting performances of a spiral antenna structure with coils in the wall and with no coils in the wall, according to certain aspects of the disclosure.

FIG. 16 is a chart 1600 illustrating gain-versus-frequency plots 1610 and 1620 respectively depicting performances of a spiral antenna structure with coils in the wall and with no coils in the wall, according to certain aspects of the disclosure. The gain-versus-frequency plot 1610 corresponds to a spiral antenna structure of the subject technology with coils in the wall. The gain-versus-circumference plot 1620 corresponds to a conventional spiral antenna structure with no coils in the wall. The X axis of the plots is the frequency in GHz. A comparison of the plots 1610 and 1620 reveals that gain performance of the spiral antenna structure of the subject technology at smaller frequencies shows a drastic improvement compared to the gain performance of the conventional spiral antenna structure. Specifically, at frequencies below 0.5 GHz, the improvement of the gain performance is about 5 dB.

In some aspects, the subject technology is related to antenna technology, and more particularly, to a spiral antenna with coiled walls. In some aspects, the subject technology may be used in various markets, including, for example, and without limitation, communication, satellite markets, and direction finding applications.

Those of skill in the art would appreciate that the various illustrative blocks, modules, elements, and components described herein are implemented as hardware.

It is understood that any specific order or hierarchy of blocks in the processes disclosed is an illustration of example approaches. Based upon design preferences, it is understood that the specific order or hierarchy of blocks in the processes may be rearranged, or that all illustrated blocks may be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single hardware and software product or packaged into multiple hardware and software products.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meanings unless otherwise explicitly and clearly defined by the patentee. If there is any conflict in the usage of a word or term in this specification and one or more patent or other documents that may be incorporated herein by reference, the definition that is consistent with this specification should be adopted.

What is claimed is:

1. A spiral antenna device comprising:

one or more conductive spiral arms formed on a dielectric substrate attached to a wall of a cylindrical cavity; and one or more coils formed on the wall of the cylindrical cavity and coupled to the one or more conductive spiral arms, wherein:

the one or more coils are printed as conductive traces on the wall of the cylindrical cavity, the one or more coils comprise multiple conductive loops formed on an inner and outer surface of the wall of the cylindrical cavity, starting points of the one or more conductive spiral arms are in a center region of the dielectric substrate, and ending points of the one or more conductive spiral arms are electrically coupled to first ends of the one or more coils.

2. The spiral antenna device of claim 1, wherein the one or more conductive spiral arms are planar spiral arms, wherein the ending points of the one or more conductive spiral arms are positioned on one or more different points of a periphery of the dielectric substrate and the first ends of the one or more coils are positioned near the ending points of the one or more conductive spiral arms.

3. The spiral antenna device of claim 1, wherein the one or more coils comprise interlaced coils formed on both sides of the wall of the cylindrical cavity, and wherein the interlaced coils wrap around the cylindrical cavity together.

4. The spiral antenna device of claim 1, wherein the one or more coils comprise noninterlaced coils that are formed separately on both sides of the wall of the cylindrical cavity, wherein the noninterlaced coils are formed on separate peripheral segments of the wall of the cylindrical cavity.

5. The spiral antenna device of claim 1, wherein each loop of the multiple conductive loops is formed of inner and outer conductive elements alternately formed on the inner and outer surface of the wall of the cylindrical cavity, and wherein each inner conductive element is connected to a neighboring outer conductive element by a conductive via.

6. The spiral antenna device of claim 5, wherein conductive loops of the multiple conductive loops are spaced with varying coil period, wherein an amplitude and a trace thickness associated with the conductive loops of the multiple conductive loops vary.

7. The spiral antenna device of claim 5, wherein the inner and outer conductive elements are respectively printed on the inner and outer surface of the wall of the cylindrical cavity, wherein lengths of the conductive loops of the multiple conductive loops of the one or more coils are different.

8. The spiral antenna device of claim 7, wherein the lengths of the conductive loops of the multiple conductive loops of the one or more coils vary linearly.

9. The spiral antenna device of claim 1, wherein second ends of the one or more coils are either floating or coupled to a ground potential directly or through an impedance matching resistor.

10. The spiral antenna device of claim 1, wherein the wall of the cylindrical cavity is tapered in thickness and is made of one or more dielectric materials with varying dielectric constants.

11. The spiral antenna device of claim 1, wherein the cylindrical cavity is loaded with one or more layers of an electromagnetic absorber material with conical geometry.

12. An apparatus comprising:

a cavity having a cylindrical wall and a dielectric substrate covering a first opening of the cavity;

one or more conductive spiral arms formed on the dielectric substrate and having their respective starting points in a center region of the dielectric substrate; and one or more coils implemented on the cylindrical wall, wherein:

the one or more coils are printed as conductive traces on the cylindrical wall, the one or more coils comprise multiple conductive loops formed on an inner and outer surface of the cylindrical wall, and ending points of the one or more conductive spiral arms are positioned on one or more different points of a periphery of the dielectric substrate and are electrically coupled to first ends of the one or more coils.

13. The apparatus of claim 12, wherein the one or more coils comprise interlaced coils formed on both sides of the cylindrical wall, and wherein the interlaced coils wrap around the cylindrical wall together and have their respective first ends positioned near the ending points of the one or more conductive spiral arms.

14. The apparatus of claim 12, wherein the one or more coils comprise noninterlaced coils that are formed on separate peripheral segments of the cylindrical wall and on both sides of the cylindrical wall.

15. The apparatus of claim 12, wherein each loop of the multiple conductive loops comprises an inner conductive element connected to a neighboring outer conductive element by a conductive via.

16. The apparatus of claim 15, wherein lengths of the conductive loops of the multiple conductive loops of the one or more coils are different and vary linearly along a periphery of the cavity.

17. The apparatus of claim 12, wherein second ends of the one or more coils are either floating or coupled to a ground potential, wherein coupling to the ground potential is through an impedance matching element.

18. A spiral antenna device with coiled walls, the spiral antenna device comprising:

a cavity having a cylindrical wall; and one or more coils implemented on the cylindrical wall, wherein:

the one or more coils are printed as conductive traces on the wall of the cylindrical wall, the one or more coils comprise noninterlaced coils, the one or more coils are formed on both sides of the wall of the cavity, the noninterlaced coils are formed on separate peripheral segments of the cylindrical wall, and the one or more coils comprise multiple conductive loops formed on an inner and outer surface of the cylindrical wall.

19. The spiral antenna device of claim 18, further comprising one or more conductive spiral arms formed on a dielectric substrate attached to the cylindrical wall of the cavity, wherein starting points of the one or more conductive spiral arms are in a center region of the dielectric substrate and ending points of the one or more conductive spiral arms are positioned near first ends of the one or more coils and are electrically coupled to the first ends of the one or more coils.

20. The spiral antenna device of claim 19, wherein second ends of the one or more coils are either of floating or coupled to a ground potential directly or through an impedance matching element.

* * * * *